United States Patent [19]

Brown et al.

[11] Patent Number: 4,696,313

[45] Date of Patent: Sep. 29, 1987

[54] EXPANSION OF TOBACCO

[75] Inventors: Ian C. Brown, Winchester; Roger W. Hedge, Lymington; David J. Molyneux, Hythe, all of England

[73] Assignee: British-American Tobacco Company Limited, London, England

[21] Appl. No.: 615,998

[22] Filed: May 31, 1984

[30] Foreign Application Priority Data

Jun. 10, 1983 [GB] United Kingdom ..... 8315987

[51] Int. Cl.[4] ..... A24B 3/18

[52] U.S. Cl. ..... 131/291; 131/296

[58] Field of Search ..... 131/291, 296, 900

[56] References Cited

U.S. PATENT DOCUMENTS

Re. 30,710 8/1981 Johnson ..... 131/901

3,575,178 4/1971 Stewart ..... 131/901

4,554,932 11/1985 Conrad et al. ..... 131/291

FOREIGN PATENT DOCUMENTS 0107932 3/1983 European Pat. Off. ..... 131/296

*Primary Examiner*—V. Millin

*Attorney, Agent, or Firm*—Kane, Dalsimer, Kane, Sullivan and Kurucz

[57] ABSTRACT

The method for expanding tabacco lamina comprises contacting the tobacco with an organic expansion agent, heating the thus contacted tobacco in a closed first vessel so that the temperature of the agent is above the boiling point of the agent at a lower release pressure, and suddenly venting the first vessel into a second vessel which is at said release pressure prior to the venting. By this means the fill volume of the tobacco is increased by a least 50%.

14 Claims, 1 Drawing Figure

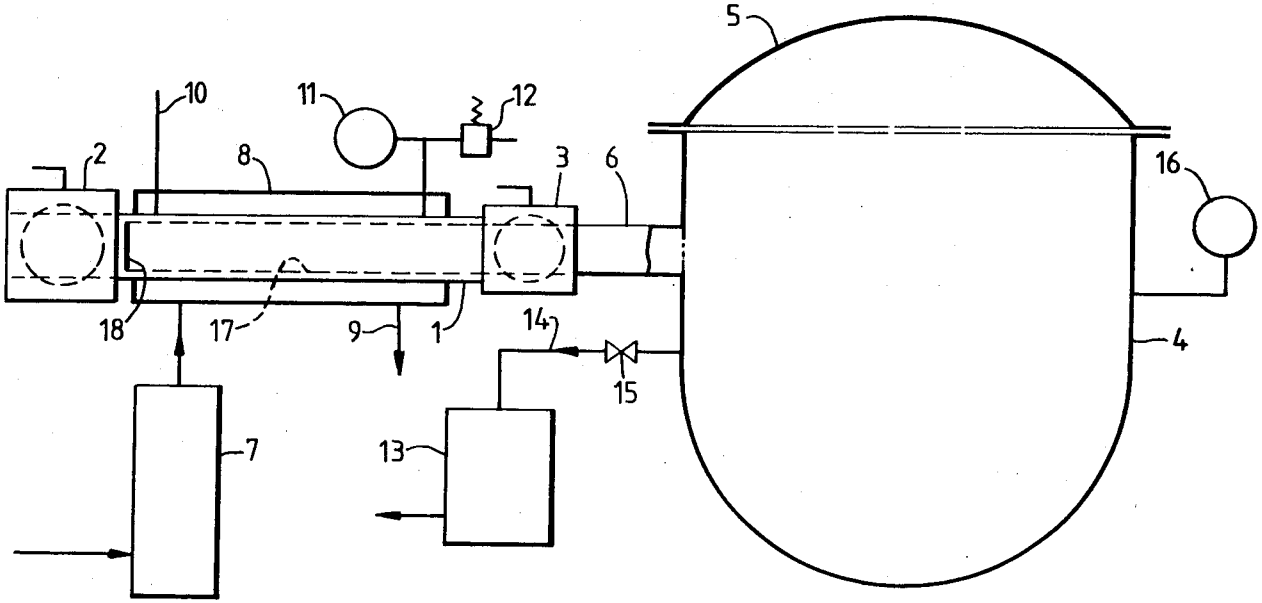
16
4
5
6
3
12
11
10
2
8
1
9
17
18
14
15
13
7

EXPANSION OF TOBACCO

This invention relates to the expansion of tobacco.

Numerous proposals have been made for expanding cured tobacco in order to effect an increase in the filling value of the tobacco. According to the majority of the prior proposed methods of expanding tobacco, a liquid or gaseous expansion agent is added to the tobacco Thereafter, the tobacco is subjected to a heating stage usually including contact with a medium such as, for example, hot air and/or steam, in order to remove the expansion agent from the tobacco. In some cases addition to the tobacco of an expansion agent causes a swelling of the cells of the tobacco, this being particularly the case in freeze drying expansion methods. In other cases the expansion of the tobacco takes place when the expansion agent is removed from the tobacco.

The expansion agent utilized in the expansion method described in U.S. Pat. No. 2,596,183 is water, whereas according to the disclosure of U.S. Pat. No. 3,524,451 a volatile organic liquid is used In an expansion method according to United Kingdom Patent Specification No. 1,444,309 tobacco is impregnated with liquid carbon dioxide and the impregnated tobacco is subjected to conditions such that the liquid carbon dioxide is converted to solid carbon dioxide. The tobacco is then heated in order to vaporize and remove the carbon dioxide.

Proposals for the use of gaseous expansion agents in tobacco expansion processes are contained in U.S. Pat. No. 4,250,898, in which carbon dioxide is the utilized gas, and United Kingdom Patent Specification No. 2,042,320A, in which nitrogen and argon are proposed gases.

Another tobacco expansion process in which use is made of a gaseous expansion agent is disclosed in U.S. Pat. No. 1,789,435. In carrying out this process compressed air is introduced into a closed chamber which contains a charge of tobacco. After a selected air pressure, 20 pounds per square inch for example, has been held for a suitable time, the chamber is suddenly vented to atmosphere, whereby there is effected a volumetric increase of the tobacco of about 15%. A somewhat similar process, used for expanding tobacco stems, is described in United Kingdom Patent Specification No. 675,292. The stems are placed in a chamber which is evacuated to free the tobacco from air. Steam is then introduced into the chamber and finally the pressure in the chamber is suddenly reduced by connecting the chamber with a further chamber in which the pressure is very low so that the pressure to which the tobacco stem material is subjected is reduced to a low value in a short time, preferably to an absolute pressure below 2 inches of mercury within one second. If the process of Specification No. 675,292 were to be used for expanding tobacco lamina, the degree of expansion obtainable would not exceed about 20%.

A method of and apparatus for expanding tobacco stems without removing the stems from the tobacco leaves is disclosed in U.S. Pat. No. 2,344,106. The leaves are fed, one-by-one, between juxtaposed runs of two endless belts carrying elements which in these runs co-operate to provide chambers which enclose the stems of the leaves. Air, or other gaseous medium, under pressure is supplied via value means to each chamber. When at the end of the juxtaposed runs a pair of elements defining a chamber are drawn apart, the pressure in the chamber defined by the elements is suddenly relieved. This is said to result in an expansion of a stem disposed in the chamber. The necessity to provide pressure tight seals between the chamber defining elements would result in difficult design and operational problems. The maximum working pressure would be low. Similar problems and limitations would be expected in attempting to expand tobacco by the methods described and illustrated in United Kingdom Patent Specification No. 1,408,262.

The present invention has an as object the provision of a practical alternative to prior proposed tobacco expansion processes, and further seeks to expand tobacco without thereby causing more than minimal chemical change in the tobacco.

The present invention provides a method of expanding tobacco lamina, comprising contacting tobacco lamina with an organic expansion agent having a boilding point temperature at a pressure of one atmosphere of at least about 10° C., heating within the interior of a closed first vessel tobacco lamina thus contacted so that the temperature of said agent in the liquid phase in said tobacco lamina attains a temperature value above the boiling point of said agent corresponding to a release pressure lower than the pressure in said first vessel at said temperature value, and subsequently bringing the interior of said vessel suddenly into gas-flow communication with the interior of a closed second vessel in which the pressure immediately before the establishment of said communication is said release pressure, whereby the filling value of said tobacco lamina is increased by at least 50%.

Methods according to the present invention are preferably carried out to produce in the tobacco lamina subjected to the methods a filling value improvement of at least 70% on an equilibrium moisture content basis The organic expansion agent is preferably one having an atmosphere boiling point above room temperature, i.e., 20° C. An expansion agent having a boiling point as high as, for example, 80° C. may be used.

The organic expansion agent may be selected from one of the following, e.g. alkanes, alkenes, alcohols, aldehydes, ketones, ethers and halocarbons.

Representative of alkanes which may be used are isopentane, n-pentane, n-hexane, methyl pentane and cyclopentane. Representative of alkenes which may be used are hexene or octene. Representative of alcohols which may be used are methanol, ethanol propan-1-ol, propan-2-ol, butan-1-ol, butan-2-ol, pentan-1-ol, pentan-2-ol or pentan-3-ol. Representative of the aldehydes which may be used are acetaldehyde, propionaldehyde or butyraldehyde. Representative of the ketones which may be used are acetone, butanone or pentanone. Representative of the ethers which may be used are di-ethyl ether, n-propyl ether or iso-propyl ether. Representative of the chlorocarbons which may be used are dichloromethane, chloroform, carbon tetrachloride, chloropropane or chlorobutane. Representative of halocarbons which may be used are dichlorofluoromethane, trichlorofluoromethane, tetrachlorodifluoroethane, trichlorotrifluorethane, bromodichloromethane, bromotrichloromethane or bromoform.

The boiling point of all these organic expansion agents is above 20° C. but it is possible to use agents having a lower boiling point, such as neopentane which has a boiling point of 9.5° C.

The organic expansion agent may be added to the tobacco in combination with water. Water alone should not be used as the expansion agent as it would be insufficiently effective.

The initial moisture content of the tobacco may be within a range of 10% to 35% but is preferably at least 18%.

The tobacco may be contacted with the agent before or after the tobacco has been placed in the first vessel. When the tobacco is contacted with the agent, the agent may be in the liquid phase. Alternatively, the agent may be brought into contact with the tobacco when the agent is in the vapour phase. In the latter case vapour condenses on the tobacco and the tobacco becomes impregnated with the condensate. If the agent is applied to the tobacco as a liquid, it may be sprayed onto the tobacco or the tobacco may be immersed for a time in the liquid agent. The agent may be brought into contact with the tobacco in a chamber which has been evacuated, or partially evacuated, the chamber suitably being the said first vessel. Whatever mode of contacting tobacco with agent is used, it is preferable that any excess liquid is removed.

It is desirable that the tobacco is not heated in the first vessel over a prolonged period. Thus the means of heating employed should be capable of raising reasonably speedily the temperature of the tobacco, and of the liquid phase organic agent therein, to the required value. For rapid heating, a microwave or dielectric heating means may be used. The heat input necessary to ensure that the expansion agent within the tobacco is at the required temperature, or a proportion of the input, may be provided by heating the agent and adding the hot agent to the tobacco, preferably after the tobacco has been disposed within the interior of the first vessel and the first vessel has been closed.

At the end of the heating step the expansion agent in the tobacco is at or near to its boilding point at the established pressure.

It is essential that at the end of the heating step liquid phase agent is present in the tobacco in sufficient quantity for the attainment of the required degree of tobacco expansion upon the interior of the first vessel being brought suddenly into gas-flow-communication with the interior of the second vessel. If necessary, in order to meet with condition, agent in the vapour phase, at suitable temperature and pressure, may be introduced into the first vessel.

The release pressure may be atmospheric pressure, but is suitably sub-atmospheric, preferably of the order of 15 kPa or less.

The sudden pressure reduction to which the tobacco is subjected when the interiors of the first and second vessels are brought into gas-flow communication suitably results not only in expansion of the tobacco, but also in a substantially total removal, by vaporization, of expansion agent from the tobacco. Water to is removed and the moisture content of the tobacco after the pressure reduction step is advantageously that required for cigarette making puroposes, i.e., 12% to 15%, so that no further drying or conditioning of the expanded tobacco is required.

Means may be provided for retaining the tobacco in the first vessel when the interior thereof is brought suddenly into gas-flow communication with the interior of the second vessel. Alternatively, no retaining means is provided, in which case the tobacco is propelled at considerable velocity into the second vessel.

The time over which the pressure release takes place should be as short as possible and preferably not more than five seconds.

The present invention also provides tobacco expansion apparatus comprising a first closable vessel, heating means operable to raise the temperature of liquid phase expansion agent within tobacco lamina placed in said first vessel, a second closable vessel, and valve means operable to bring the interior of said first vessel suddenly into gas-flow communication with the interior of said second vessel. Preferably, the apparatus includes means for drawing a partial vacuum in said second vessel. The apparatus may also comprise a third vessel from which the expansion agent in vapour phase may be supplied to the first vessel.

In order that the present invention may be clearly understood and readily carried into effect, reference will now be made, by way of example, to the accompanying drawing, which shows diagrammatically an expansion apparatus.

The expansion apparatus comprises a first elongate, horizontally disposed vessel 1 which is provided, at respective ends thereof, with an inlet ball valve 2 and an outlet ball valve 3. The expansion apparatus further comprises a second vessel 4, which second vessel is fitted with a removable lid 5. The interior of the first vessel 1 may be brought into communication with the interior of the second vessel 4 via the valve 3 and a pipe 6.

In order to heat the vessel 1, steam, at 800 kPa absolute pressure for example, is superheated in a gas fired superheater 7 and is then circulated around a steam jacket 8 surrounding the vessel 1. Steam exhausts from the jacket 8 via a line 9.

The temperature within the interior of the vessel 1 may be monitored by a thermocouple device indicated at 10. The pressure within the interior of the vessel 1 may be read from a pressure gauge 11. Reference numeral 12 designates an over-pressure relief valve. The vessel 1 and associated valves 2, 3 are able to withstand a working pressure of 1150 kPa.

The interior of the second vessel 4 may be evacuated by means of a vacuum pump 13 which is connected to the vessel 4 via a line 14, in which is fitted an isolating valve 15. The value of the vacuum drawn within the interior of the vessel 4 may be read from a vacuum gauge 6.

In a first experiment 15 g of an 80:20 lamina/stem blend at a moisture content of 16% were loaded into an elongate, cylindrical wire mesh basket. The basket is indicated in broken line in the drawing and is designated by reference numeral 17. The basket 17 comprises a blank end plate 18 and is open at the other end. With the basket 17 standing upright and resting on the end plate 18, 10 cc of chloroform were poured onto the tobacco and the basket was immediately advanced into the vessel 1 via the inlet valve 2. The interior of the vessel had been pre-heated to 110° C. by the circulation of steam through the steam jacket 8. With the tobacco containing basket 17 in position in the vessel 1 and with the inlet and outlet valves 2, 3 in the closed positions therefore, superheated steam was passed through the jacket 8. After a heating period of 12 minutes the temperature in the vessel 1 was 175° C. and the pressure was 620 kPa.

Meantime, the vacuum pump 13 was used to lower the pressure in the vessel 4 to 15 kPa absolute. Thus, when at the end of the 12 minutes heating period the outlet valve 3 was turned rapidly to its fully open position, the tobacco was shot from out of the basket 17 into the vessel 4. The basket 17 cannot be moved in the same direction because the diameter thereof is greater than that of the bore of the outlet valve 3.

The tobacco taken from vessel 4 was found to have a moisture content of 9.5%. It was found that the specific particle volume of the tobacco had been increased by 80% compared with that of the same tobacco blend not subjected to the expansion method, taken on an equilibrium moisture content basis. The filling value, also taken on an equilibrium moisture content basis, was found to have been increased by 56%.

In a second experiment the procedure of the first experiment was repeated using the same tobacco blend, except that instead of chloroform being used as the expansion agent, 19 cc of acetone were used. After a 12 minutes heating period the temperature and pressure in the vessel 1 were 190° C. and 790 kPa respectively. The moisture content of the tobacco taken from the vessel 2 at the conclusion of the experiment was 8.5%. The increase in specific particle volume was found to be 95% and the increase in filling volume was found to be 71%.

In a third experiment the procedure of the first experiment was repeated using the same tobacco blend but at a moisture content of 24%, the expansion agent being 50 cc of trichlorofluoromethane. After a heating period of 8 minutes a temperature of 190° C. and a pressure of 862 kPa were reached in vessel 1, after which time vessel 1 was rapidly interconnected with vessel 4, the prior pressure in which was 15 kPa. The increase in the specific particle volume was found to be 89% and the increase in filling value was found to be 70%.

The procedure followed in a fourth experiment was similar to that of the third experiment except that 50 cc n-pentane were used as the expansion agent and the temperature and pressure in vessel 1 were 185° C. and 772 kPa. The increase in the specific particle volume was found to be 60% and the increase in filling value was found to be 52%.

The procedure followed in a fifth experiment was similar to that of the third experiment except that the moisture content of the tobacco was 18%, the expansion agent was 35 cc carbon tetrachloride. After a heating period of 12 minutes a temperature and pressure of 200° C. and 662 kPa were reached in vessel 1. The increase in specific particle volume was found to be 77% and that in filling value to be 61%.

The procedure followed in a sixth experiment was similar to that of the fifth experiment except that the expansion agent was di-ethyl ether and after a heating period of 7 minutes a temperature and pressure of 181° C. and 765 kPa were reached in vessel 1. The increase in specific particle volume was found to be 86% and the increase in filling value was found to be 70%.

What is claimed is:

1. A method of expanding tobacco lamina, comprising contacting tobacco lamina with an organic expansion agent in the liquid phase having a boiling point temperature at a pressure of one atmosphere, of at least, about 20° C., heating within the interior of a closed first vessel tobacco lamina thus contacted so that the temperature of said agent in the liquid phase in said tobacco lamina attains a temperature value above the boiling point temperature corresponding to a release pressure of said agent, which release pressure is lower than the pressure in said first vessel at said temperature value, said temperature value being below the boiling point temperature of said agent at said pressure in said first vessel, and subsequently bringing the interior of said first vessel suddenly into gas flow communication with the interior of a closed second vessel in which the pressure immediately before the establishment of said communication is said release pressure, whereby the filling value of said tobacco lamina is increased by at least 50%.

2. A method as claimed in claim 1, wherein the filling value of said tobacco lamina is increased by at least 70%.

3. A method as claimed in claim 1, wherein the initial moisture content of said tobacco lamina is within a range of 10% to 35%.

4. A method as claimed in claim 3, wherein the initial moisture content of said tobacco lamina is at least 18%.

5. A method as claimed in claim 1 wherein when said tobacco lamina is contacted with said expansion agent, said expansion agent is in the liquid phase.

6. A method as claimed in claim 1 wherein when said tobacco lamina is contacted with said expansion agent, said expansion agent is in the vapour phase and condenses on said tobacco lamina.

7. A method as claimed in claim 1 wherein said tobacco lamina is contacted with said expansion agent in an at least partially evacuated chamber.

8. A method as claimed in claim 1 wherein when said tobacco lamina is contacted with said expansion agent, said expansion agent is at an elevated temperature.

9. A method as claimed in claim 1, wherein said release pressure is a sub-atmospheric pressure.

10. A method as claimed in claim 1, wherein said expansion agent is selected from one of alkanes, alkenes, alcohols, aldehydes, ketones, ethers and halocarbons.

11. A method as claimed in claim 1, wherein said expansion agent is one of acetone, carbon tetrachloride, chloroform di-ethyl ether, n-pentane or trichlorofluoromethane.

12. A method as claimed in claim 1 wherein the expansion agent has a boiling point above 20° C. at a pressure of one atmosphere.

13. A method as claimed in claim 12 wherein the expansion agent has a boiling point below 80° C. at a pressure of one atmosphere.

14. A method as in any of claims 1 to 8 wherein said tobacco lamina is retained in said first vessel when the interior of said first vessel is brought into the gas flow communication with the interior of said second vessel.

* * * * *